US005423201A

United States Patent [19]

Steinmair et al.

[11] Patent Number: 5,423,201

[45] Date of Patent: Jun. 13, 1995

[54] APPARATUS FOR CONTINUOUSLY SHAPING A METAL TUBE

[75] Inventors: Karl Steinmair, Schiedlberg; Erwin Aigner, Linz; Gert Kitzinger, St. Valentin, all of Austria

[73] Assignee: Voest-Alpine Industrieanlagenbau GmbH, Linz, Austria

[21] Appl. No.: 99,154

[22] Filed: Jul. 29, 1993

[30] Foreign Application Priority Data

Aug. 3, 1992 [AT] Austria ..... 1569/92

[51] Int. Cl.[6] ..... B21B 13/10; B21B 31/16

[52] U.S. Cl. ..... 72/225; 72/244; 72/248

[58] Field of Search ..... 72/224, 225, 237, 244, 72/248, 249

[56] References Cited

U.S. PATENT DOCUMENTS

| | | | |
|---|---|---|---|
| 1,308,945 | 7/1919 | Gail | 72/225 |
| 1,697,012 | 1/1929 | Kronenberg | 72/248 |
| 1,796,447 | 3/1931 | Foren | 72/248 |
| 3,347,078 | 10/1967 | Keska et al. | 72/225 |

FOREIGN PATENT DOCUMENTS

| | | | |
|---|---|---|---|
| 1267303 | 6/1961 | France | 72/225 |
| 185322 | 8/1966 | U.S.S.R. | 72/244 |

*Primary Examiner*—Lowell A. Larson
*Assistant Examiner*—Thomas C. Schoeffler
*Attorney, Agent, or Firm*—Collard & Roe

[57] ABSTRACT

An apparatus is provided for continuously shaping a metal tube by means of shaping rollers, which are arranged around the tube and consist of pairs of rollers disposed on opposite sides of the axis of the tube. It is desired to permit an adaptation of the apparatus to tubes which differ in size and in final shape. This is accomplished in that each shaping roller is radially adjustable relative to the tube and is mounted to be pivotally movable about a pivotal axis which is parallel to the axis of the tube. Said pivotal axis extends through the center of curvature of an arc of a circle which is at least approximated by that portion of the rolling contour which is defined by said shaping roller or said pivotal axis is spaced from said center of curvature in a direction which is parallel to the axis of said shaping roller.

21 Claims, 6 Drawing Sheets

APPARATUS FOR CONTINUOUSLY SHAPING A METAL TUBE

TECHNICAL FIELD

This invention relates to an apparatus for continuously shaping a metal tube as it moves along a predetermined path by means of pairs of shaping rollers, which are arranged around said path, wherein the rollers of each pair are arranged diametrically opposite to each other with respect to said path, the axes of said shaping rollers lie in a common plane, which is perpendicularly to said path, each of said shaping rollers is mounted to be pivotally movable about a pivotal axis which is parallel to said path, and the shaping rollers have profiles which determine the rolling contour according to which the tube is to be shaped and have a larger radius of curvature than the associated portions of the outside periphery of the tube before it approaches said shaping rollers.

BACKGROUND OF THE INVENTION

When a round tube is continuously to be shaped in a plurality of shaping steps to a rectangular tube, it is known (FR-B 1,267,303) to provide in a rolling line a plurality of shaping stands, which are arranged in series and consist each of two pairs of diametrically oppositely arranged shaping rollers, the profiles of which constitute a substantially closed rolling contour. Because the radius of curvature of the profiles of the shaping rollers and, as a result, the radius of curvature of the associated portions of the rolling contour, is larger than the radius of curvature of the corresponding portion of the periphery of the tube as it enters a given stand, the tube is flattened in steps in the consecutive stands in the peripheral portions corresponding to the flat walls which are to be formed until the final rectangular shape has been achieved. Those known shaping stands have the disadvantage that the shaping rollers closely adjoin each other in the peripheral direction to define a closed shaping contour so that a change of the size of the rolling contour and an adaptation to different tube diameters cannot be effected unless the shaping rollers are replaced by shaping rollers having a correspondingly changed profile. The resulting alteration of the shaping stands involves a relatively large amount of work and also requires the entire shaping plant to be shut down.

In an attempt to avoid said disadvantages, a shaping apparatus has been disclosed (U.S. Pat. No. 3,347,078), in which the shaping rollers are arranged in pairs of diametrically opposite rollers and have eccentric profiles so that the diameter of each shaping roller gradually decreases from one end of the roller to the other and each shaping roller is adapted to be so displaced that its end which is larger in diameter approaches the adjacent shaping roller, which has an axis that is perpendicularly to the axis of the shaping roller thus displaced. In that case that end of the first-mentioned roller which is larger in diameter arrives adjacent to that end of the second roller which is smaller in diameter and, as a result, the profiles of the several shaping rollers, which profiles determine the rolling contour, overlap each other and the rolling contour is correspondingly reduced in size. This requires that each shaping roller is mounted in the stand to be adjustable in a radial direction relative to the tube to be shaped and in the direction of the axis of said roller. But the eccentric profile of each shaping roller necessitates that for an adjustment of the shaping rollers in adaptation to tubes having a different diameter the rolling contour must be rotated about the axis of the tube. Unless a twisting of the tube being shaped is permissible, it will be necessary to pivotally adjust the shaping rollers of each pair about the axis of the tube in opposite senses. This can be permitted if the shaping rollers are mounted in a rotatably mounted frame. Besides, each shaping roller can be pivotally adjusted individually so that the profile which determines the rolling contour can properly be aligned, particularly if that profile is composed of a plurality of sections corresponding each to an arc of a circle and having different radii. A disadvantage of that known apparatus resides mainly in its relatively large structural expenditure and in the fact that the tube is necessarily twisted as it is shaped unless special measures are taken.

SUMMARY OF THE INVENTION

It is an object of the invention to provide for the continuous shaping of a metal tube an apparatus which is of the kind described first hereinbefore and is so improved that the rolling contour can be adapted to a given tube diameter without a need to replace the shaping rollers and without the disadvantages involved in the use of shaping rollers having eccentric profiles.

That object is accomplished in accordance with the invention in that each shaping roller has a profile which is symmetrical with respect to the diametral center plane of the roller and each shaping roller is mounted to be movable about a pivotal axis which extends through the center of curvature of the associated portion of the rolling contour or is spaced from the center of curvature in a direction which is parallel to the axis of the roller.

In other words the location of the pivotal axis for each of said shaping rollers can be defined by stating that the periphery of each shaping roller has a generatrix which defines a portion of said rolling contour and is concave toward the other roller of the same pair and at least approximates an arc of a circle having a predetermined radius of curvature and the pivotal axis for each of said shaping rollers is disposed on the same side of said roller as said center of curvature and is spaced from the axis of said shaping roller by the same distance as said center of curvature.

As a shaping roller is pivotally moved about a pivotal axis which extends through the center of curvature of that portion of the rolling contour which is defined by that roller, that portion of the rolling contour which is defined by that roller will not be changed because the shaping roller is displaced along said portion of the rolling contour in the plane which is perpendicularly to the axis of the tube to be shaped. Only the length of the portion of the rolling contour which is defined by each shaping roller is changed and this is an essential requirement for a simple adaptation to different tube diameters. It will be understood that the rolling contour must sufficiently be defined by the shaping rollers if the rolling operation is to have the desired result.

In apparatuses which are required to permit an adaptation to tube diameters in a relatively large range it will be preferred to provide overlapping shaping rollers which define the rolling contour. For this purpose each shaping roller may be formed in at least one end face with a recess which is coaxial to the axis of the roller and adapted to receive an outer edge portion of the adjacent end face of the adjacent shaping roller as two adjacent shaping rollers are moved toward each other. The provision of that recess permits two adjacent shaping rollers to be pivotally moved about the respective centers of curvature of those portions of the rolling contour which are defined by said rollers and the outer edge portion of one end of one of said shaping rollers may then enter the recess in the adjacent end face of the other shaping roller so that the two adjacent shaping rollers overlap. Whereas the two adjacent shaping rollers which have been pivotally moved so that the two adjacent shaping rollers overlap cannot define a continuous rolling contour, the extent of the contact between said shaping rollers and the tube will be sufficient for a satisfactory shaping of the tube.

The pivotal movement of each shaping roller about the center of curvature of the associated portion of the rolling contour requires a radial displacement of the shaping roller. For that purpose the shaping rollers may be radially displaced relative to the tube. A separate guide will not be required for the radial displacement of the shaping rollers if the pivotal axis for each shaping roller is spaced form the center of curvature of the associated portion of the rolling contour in a direction which is parallel to the axis of the shaping roller. A pivotal movement of a shaping roller about such a pivotal axis will have the result that the center of curvature of that portion of the rolling contour which is associated with that roller is displaced along an arc of a circle in a direction which is substantially radial with respect to the tube owing to the direction of said spacing so that said pivotal movement will be accompanied by a radial displacement of the shaping roller and of the associated portion of the rolling contour. Because the range of the pivotal movement is restricted and the rise of the arc along which the center of curvature of the associated portion of the rolling contour is moved is relatively small, the change of the inclination of the portion of the rolling contour which results from the displacement of the center of curvature in the direction of the axis of the associated shaping roller will be negligibly small and will not affect the result of the rolling operation.

If the distance of the pivotal axis for each shaping roller from the center of curvature of the associated portion of the rolling contour in a direction which is parallel to the axis of the shaping roller is determined in dependence on the angle through which the shaping roller is to be pivotally moved for an adaptation to a given different tube diameter and on the difference between the tube diameters associated with said angle, the pivotal adjustment of the shaping rollers may be used to impart to the shaping roller the radial displacement which is required for an adaptation to a given tube diameter and this will be accomplished without the need for an additional radial drive.

The requirements for the location of the pivotal axes for the shaping rollers hardly permit said axes to be defined by physical pivot members. A suitable pivotal movement of the shaping roller can desirably be obtained in that each shaping roller is rotatably mounted on a roller-mounting carriage, which is adjustable along a guide that defines an arc of a circle that is centered on the pivotal axis of said shaping roller so that the displacement of said carriage along the arcuate guide will result in the desired pivotal adjustment of the shaping roller. For a radial adjustment of the shaping roller, each arcuate guide may be mounted on a second carriage, which is radially movable relative to the tube. By a displacement of said second carriages the rolling contour can be adjusted for the shaping of tubes to different rectangular shapes.

The shaping rollers of each pair should be adjustable by symmetrical movements. This can be achieved in a simple manner by the provision of means by which corresponding carriages associated with the shaping rollers of each pair can be adjusted in unison. In that case the control will be particularly simple if corresponding carriages associated with the shaping rollers of each pair are operatively interconnected and are adjustable by common drive means so that the otherwise existing need for synchronizing means will be eliminated.

DETAILED DESCRIPTION OF THE PREFERRED EMBODIMENTS

Figure 1:
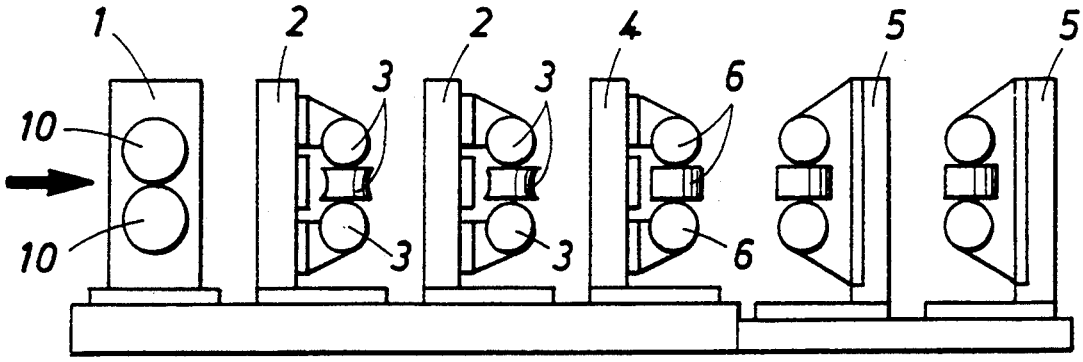
FIG. 1 is a schematic side elevation showing a shaping plant for the continuous production of a rectangular tube from a circular tube by means of shaping apparatuses in accordance with the invention.

Illustrative embodiments of the invention will now be described in detail with reference to the drawing.

Figure 2:
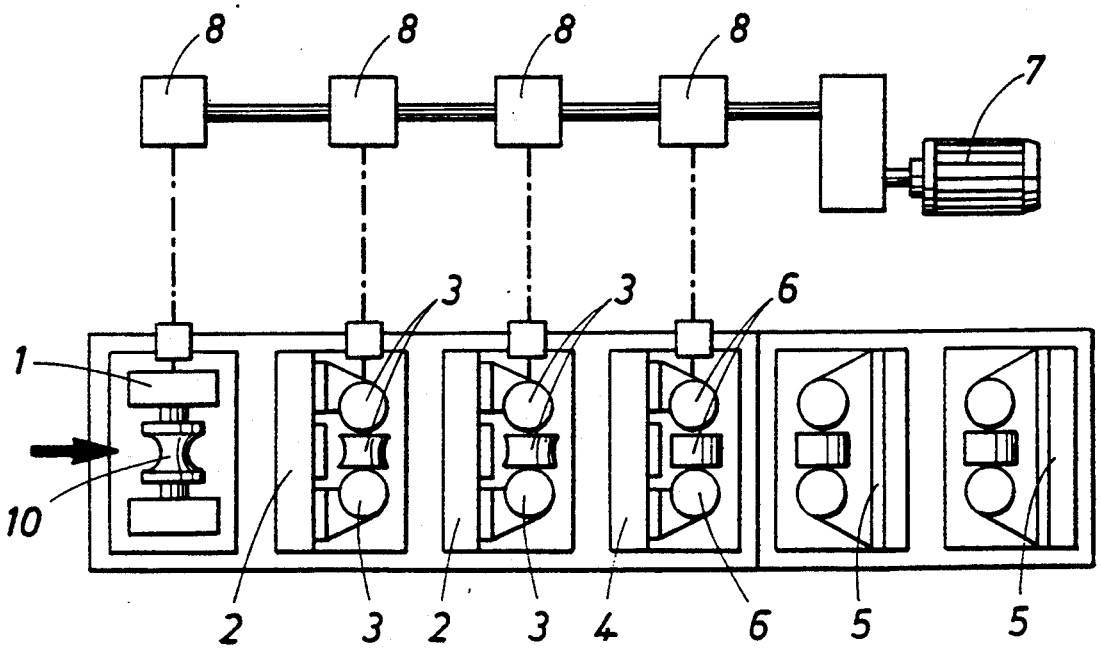
FIG. 2 is a schematic top plan view showing that shaping plant.
Figure 7:
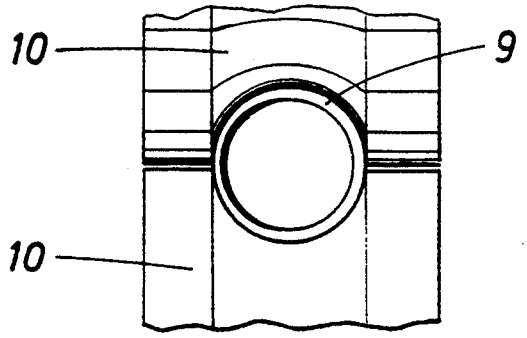
FIGS. 7 to 9 are schematic transverse sectional views respectively showing a round starting tube, a tube having an intermediate shape, and a square final tube, together with the corresponding shaping rollers.
Figure 8:
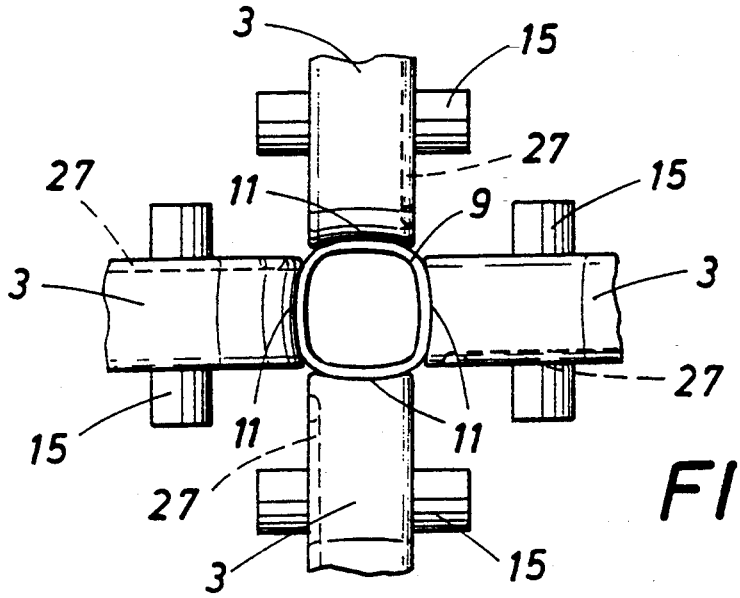
Figure 9:
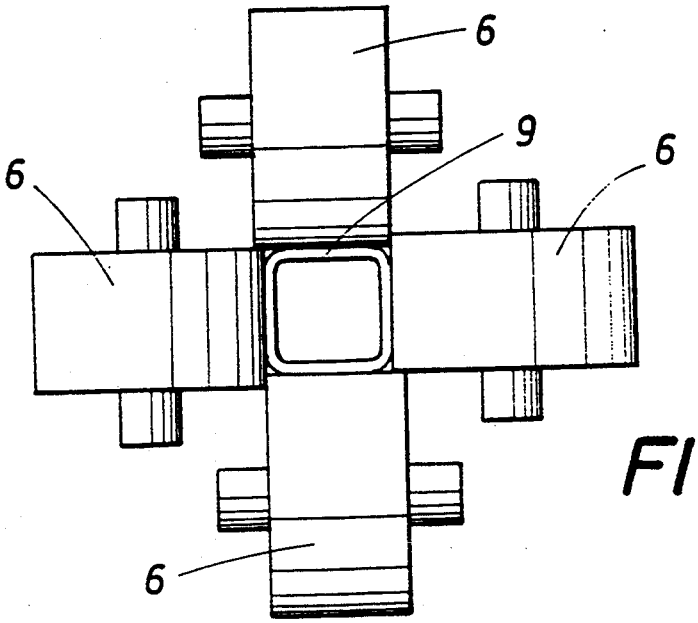

The shaping plant shown in FIGS. 1 and 2 comprises a calibrating rolling stand 1 for calibrating an incoming round tube, two shaping stands 2, which succeed the calibrating stand 1 and comprise shaping rollers 3 having a profile which at least approximates an arc of a circle having a predetermined radius of curvature that is larger than the radius of curvature of an arc of a circle which is at least approximately the associated portion of the periphery of the tube which enters the stand, and a calibrating rolling stand 4 for the final tube, which after the calibrating stand 4 passes through two straightening stands 5. The shaping rollers 6 of the final calibrating stand 4 differ from the shaping rollers 3 of the shaping stands 2 in that they have a straight profile. Each stand is driven by a motor 7 and power dividers 8 for driving respective shaping rollers. In that plant the circular tube is shaped in steps, as is indicated in FIGS. 7 to 9. The tube 9 leaving the calibrating rollers 10 of the calibrating stand 1 has a predetermined circular cross-section shown in FIG. 7 and is successively flattened by the shaping stands 2 adjacent to the subsequently formed side walls of the tube. One of said steps is illustrated in FIG. 8, from which it is apparent that the shaping rollers 3 are arranged in pairs of diametrically opposite rollers and the periphery of each of said rollers has a generatrix 11 which at least approximates an arc of a circle that has a predetermined radius of curvature. That generatrix is symmetrical with respect to the diametral center plane of the shaping roller 3. The radius of that arc of a circle is larger than the radius of the generatrix of the shaping rollers of the immediately preceding shaping stand so that the shaping rollers 3 define the rolling contour which is also shown in FIG. 8. In the calibrating stand 4 the tube 9 is given the square final shape by means of the straight shaping rollers 6.

Figure 3:
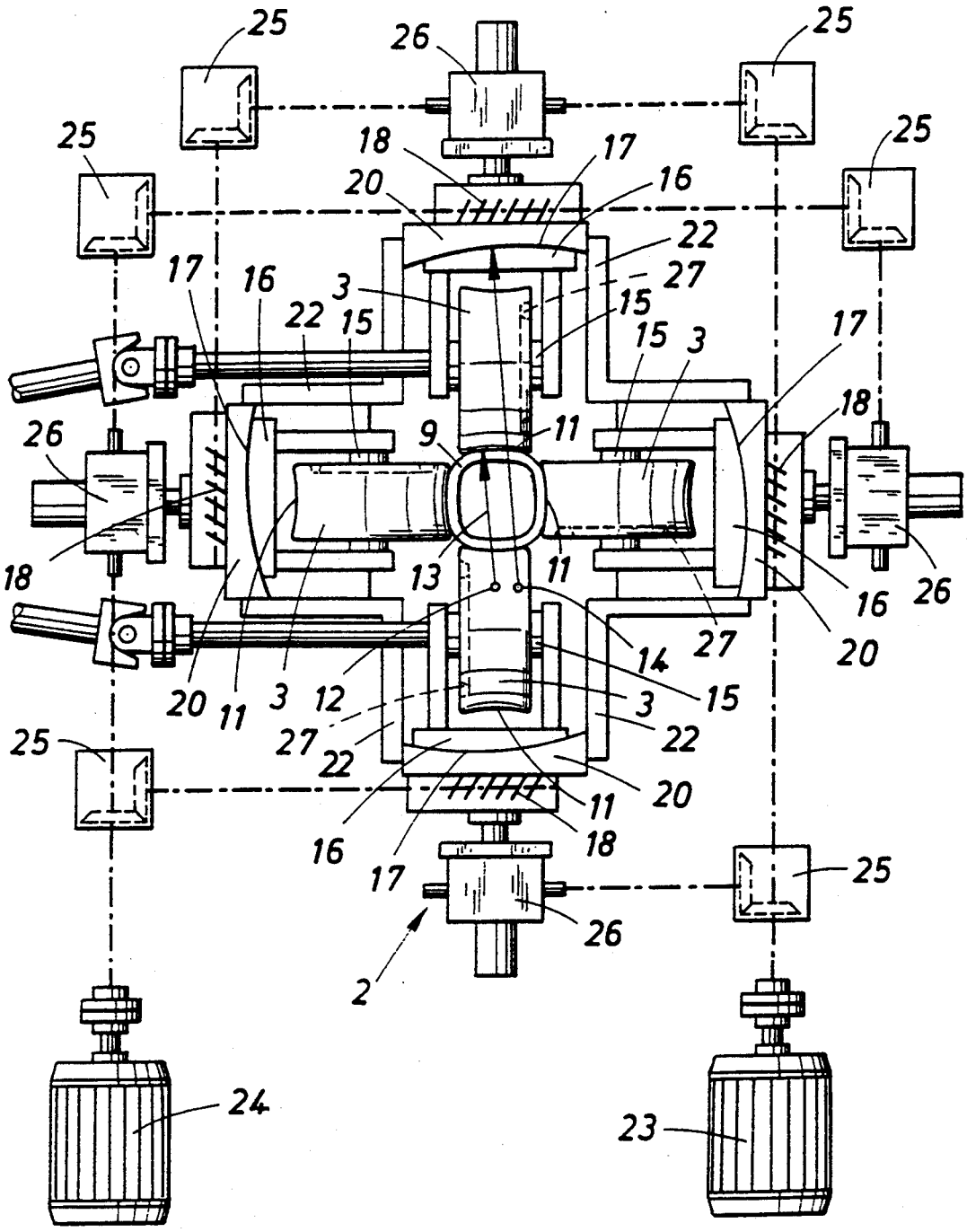
FIG. 3 is a schematic front elevation showing an apparatus for shaping a tube, which apparatus is viewed in the direction of the axis of the tube.

The design of the shaping stands 2 is shown more in detail in FIG. 3. Each shaping roller has a generatrix 11, which faces and is concave toward the path for the tube 9 and at least approximates an arc of a circle and defines a portion of a rolling contour according to which the tube is to be shaped. The center of curvature 12 of an arc of a circle which is at least approximated by that portion of the rolling contour which is defined by the upper shaping roller 3 and the associated radius of curvature 13 are represented in FIG. 3. The present shaping stands 2 differ from conventional shaping stands used for the same purpose in that each shaping roller 3 can be pivotally moved about a pivotal axis which is parallel to the axis of the tube and to the axis of the rolling operation. That pivotal axis for the upper shaping roller 3 is designated 14. The pivotal axis 14 is spaced from the center of curvature 12 in a direction which is parallel to the axis 15 of the shaping roller 3. As a result, a pivotal movement of the shaping roller 3 about the pivotal axis 14 will be accompanied by a radial displacement of the shaping roller 3. This result will be immediately apparent from the drawing if it is borne in mind that a pivotal movement of the upper shaping roller 3 about the pivotal axis 14 will result in an arcuate movement of the center of curvature about the pivotal axis 14 so that said center of curvature 12 is radially displaced relative to the axis of the tube. Because the angle of the pivotal movement of the center of curvature 12 is restricted, the extent to which the center of curvature 12 is displaced in the direction which is parallel to the axis 15 of the roller is only small so that the resulting change of the inclination of the portion of the rolling contour is negligibly small.

Figure 4:
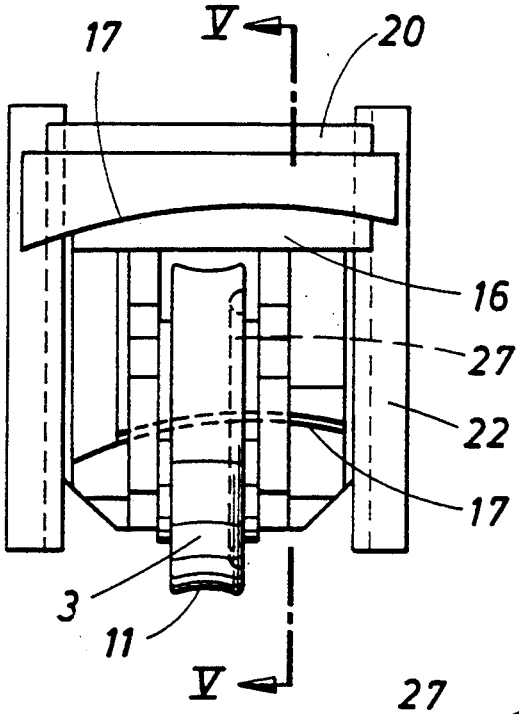
FIG. 4 is a front elevation drawn to a larger scale and showing the roller-mounting carriage for guiding a shaping roller, viewed in the direction of the axis of the tube.
Figure 5:
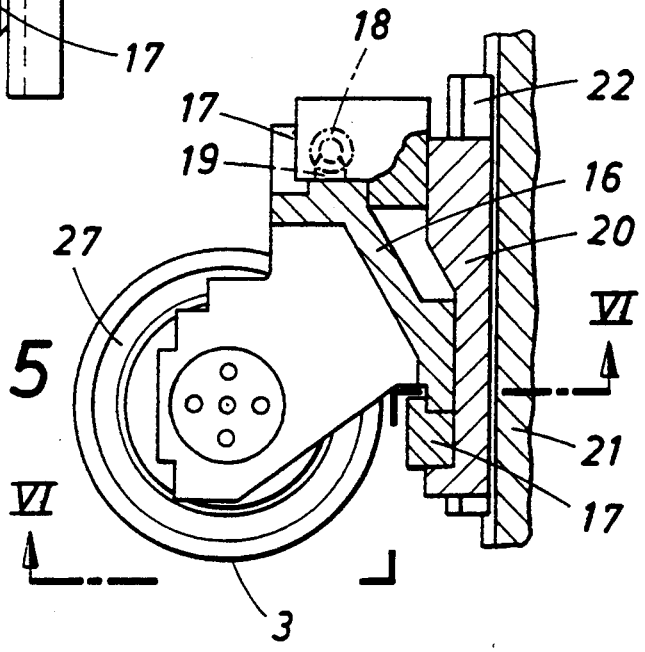
FIG. 5 is a sectional view taken on line V—V in FIG. 4.
Figure 6:
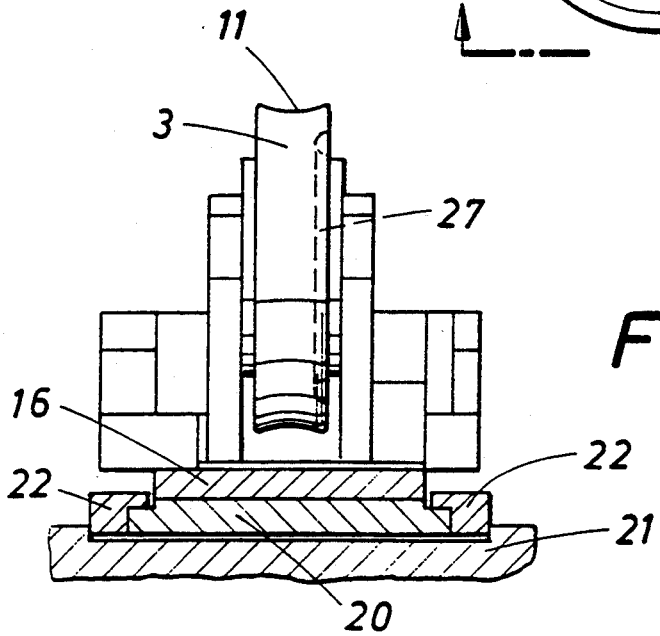
FIG. 6 is a sectional view taken on line VI—VI of FIG. 5.

To movably mount the shaping rollers 3 so that they can perform said pivotal movement, each shaping roller 3 is rotatably mounted in accordance with FIGS. 4 to 6 on a roller-mounting carriage 16, which is movable along an arc of a circle, which is defined by a guide 17 and has a center of curvature which coincides with the pivotal axis 24, as is indicated in FIG. 3. The carriage 16 is driven by a worm shaft 18, which meshes with a gear 19, which is provided on the carriage 16 (FIG. 5). Because the arcuate guide 17 for the carriage 16 is provided on a second carriage 20, which is held in the frame 21 of the shaping stand 2 in guides 22, which are radial with respect to the tube 9, the shaping rollers 3 can be pivotally moved and radially adjusted at the same time.

Drive means for adjusting carriages 16 and 20 comprise motors 23 and 24 and power dividers 25. The arrangement is such that corresponding carriages associated with the diametrically oppositely arranged shaping rollers 3 of each pair are operatively interconnected so that the movements of the two shaping rollers are symmetrical and synchronized. For instance, in accordance with FIG. 3 the radial movements are imparted to the second carriages 20 associated with the upper and lower shaping rollers 3 by the motor 23, which drives corresponding screw drives 26. The screw drives 26 for radially adjusting the second carriages 20 associated with the left-hand and right-hand shaping rollers 3 are similarly driven by the motor 24. The means for imparting the pivotal movement to the shaping rollers 3 are similarly combined. The worm shafts 18 associated with the upper and lower shaping rollers 3 are driven by the motor 24 and the worm shafts 18 for pivotally moving the laterally disposed shaping rollers 3 are driven by the motor 23.

To permit adjacent shaping rollers 3 to overlap each other as they are pivotally moved, each shaping roller 3 is formed in one end face with a recess 27, which is co-axial to the axis 15 of the roller and is adapted to receive an outer edge portion of the adjacent end face of the adjacent shaping roller 3 as the said two adjacent shaping rollers are pivotally moved to approach each other. Because the profiles of the shaping rollers can thus be caused to overlap each other, it is possible to adapt the rolling contour to different tube diameters and to different shapes of rectangular tubes without a need for a replacement of the shaping rollers 3 and without a risk of a twisting of the tube.

Figure 10:
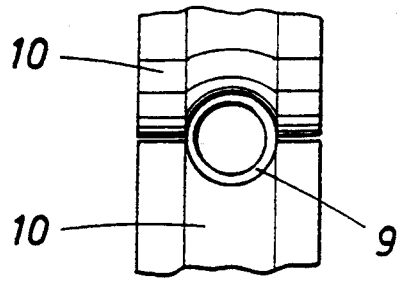
FIGS. 10 to 12 are views which correspond to FIGS. 7 to 9 and illustrate the shaping of a starting tube having a different diameter.
Figure 11:
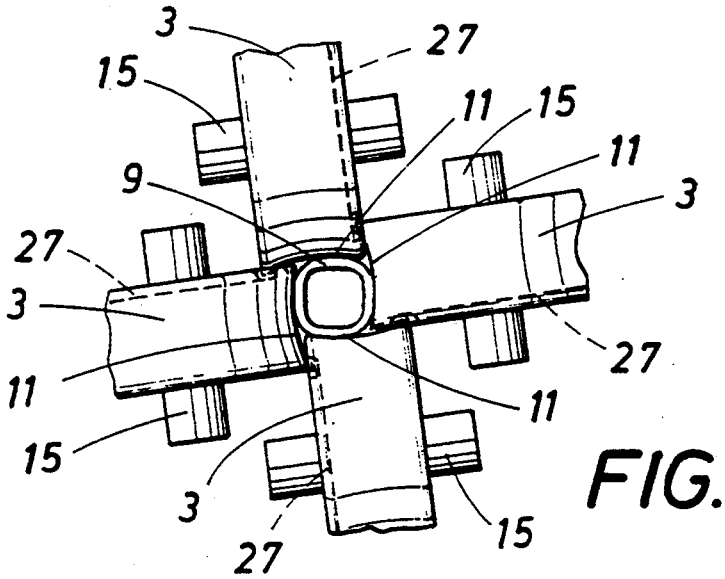
Figure 12:
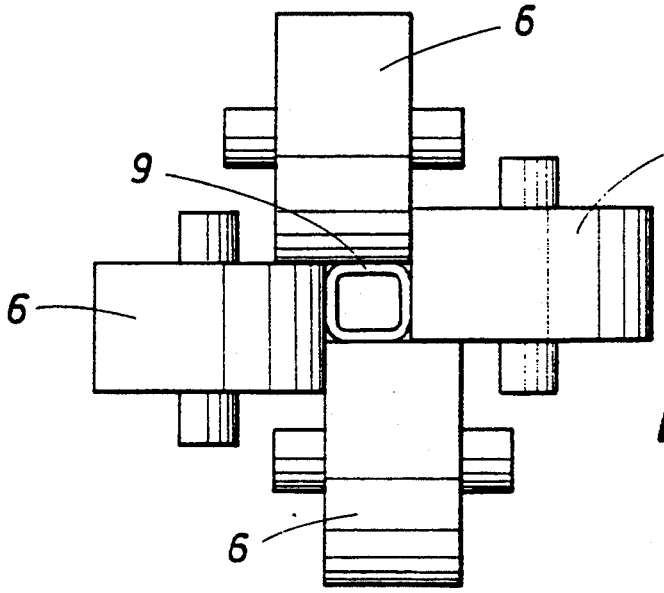
Figure 13:
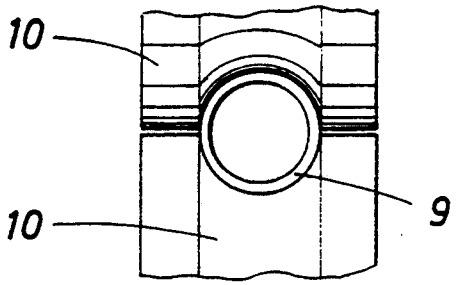
FIGS. 13 to 15 are views which correspond to FIGS. 7 to 9 and illustrate the shaping of a round tube to a rectangular tube.
Figure 14:
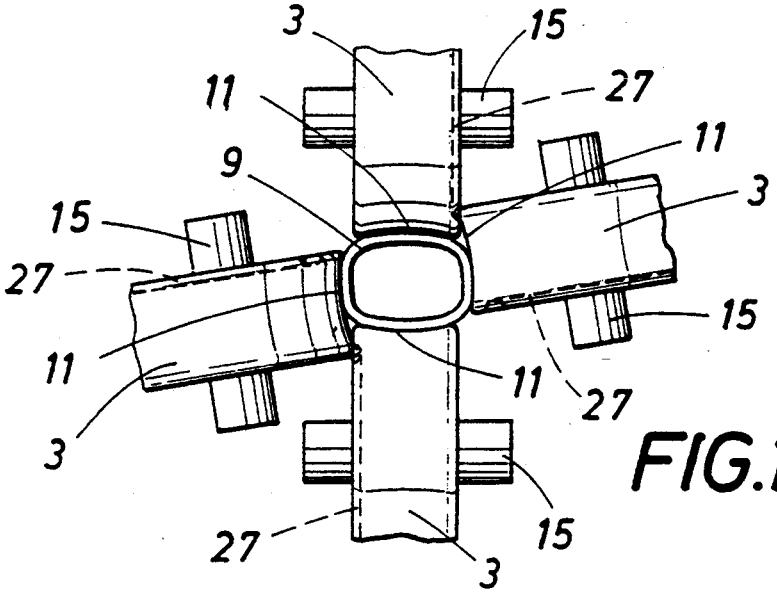
Figure 15:
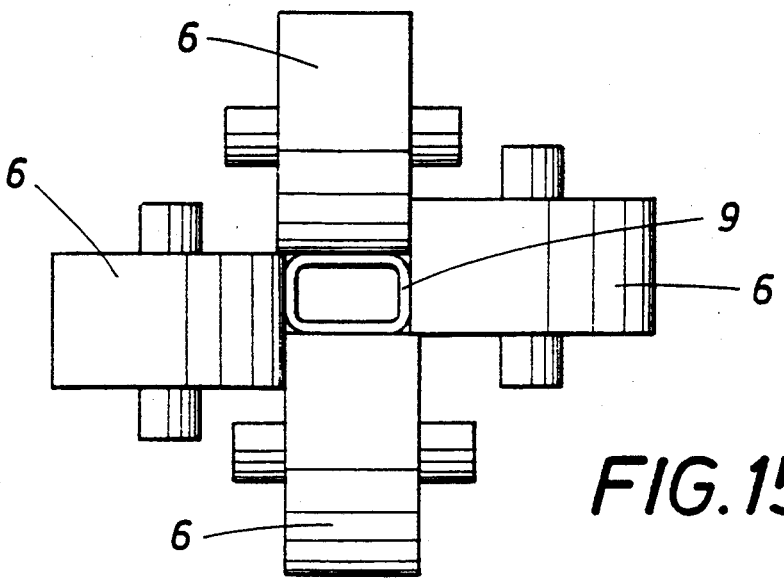

FIGS. 7 to 9 illustrate a shaping of the tube 9 when the starting tube 9 has the largest diameter for which the plant is suitable. In that case the shaping rollers 3 adjoin each other in the peripheral direction without an overlap as is shown in FIG. 8 so that conventional conditions are provided. FIGS. 10 to 12 illustrate the shaping of a tube which is initially smaller in diameter. Upon a comparison of FIGS. 7 to 9 and FIGS. 10 to 12 it is directly apparent that the calibrating rollers 10 of the calibrating stand 1 must be replaced whereas it is not necessary to replace the shaping rollers 3 ofthe succeeding shaping stands 2 because shaping rollers 3 can be pivotally moved and radially displaced toward the tube 9 at the same time, as is apparent from FIG. 11. It will be understood that FIG. 11 illustrates only one of the two intermediate steps of the shaping of the tube. That special adjustment of the shaping rollers 3 results in an overlap of adjacent shaping rollers 3 so that the rolling contour can be adapted to a desired tube diameter. Whereas the rolling contour does not contact the tube, throughout its periphery, the tube is contacted by the rolling contour to a sufficiently large extent for a satisfactory shaping of the tube. For an adaptation to the changed size of the square cross-section of the tube, the shaping rollers 6 of the final calibrating stand 4 can be radially and axially displaced as is apparent from FIG. 12. FIGS. 13 to 15 illustrate the making of a rectangular tube. In that case only one of the pairs of diametrically opposite shaping rollers 3 have been pivotally moved whereas the shaping rollers 3 of the other pair have been only radially adjusted. The cooperation of the pairs of shaping rollers 3 is readily apparent from FIG. 14 and need not be described in more detail.

We claim:

1. An apparatus for continuously shaping a metal tube as it moves along a predetermined path, comprising a plurality of shaping rollers arranged around said path and consisting of pairs of shaping rollers which are diametrically opposite each other with respect to said path, said shaping rollers having axes extending in a common plane perpendicularly to said path, and each of said shaping rollers being mounted to be pivotally movable about an associated pivotal axis which is parallel to said path, each of said shaping rollers having a periphery defining a generatrix, which faces and is concave toward said path and at least approximates an arc of a circle having a predetermined radius of curvature and extending about a center of curvature, the arc defining a portion of a rolling contour according to which said tube is to be shaped, said generatrix of each of said shaping rollers being symmetrical with respect to a diametral center plane of the respective shaping roller, and said pivotal axis associated with each of said shaping rollers being disposed on the same side of the respective shaping roller as the center of curvature associated with the respective shaping roller and being spaced from the axis of the respective shaping roller by the same distance as the associated center of curvature, and from the associated center of curvature in a direction which is parallel to the axis of the respective shaping roller.

2. An apparatus according to claim 1 which is operable to shape a metal tube having peripheral portions each of which has a predetermined shape, which at least approximates an arc of a circle having a radius of curvature, which is smaller than said predetermined radius of curvature of said arc of a circle which is at least approximated by said generatrix of each of said shaping rollers wherein each of said shaping rollers is adapted to engage an associated one of said peripheral portions of said tube and said generatrix of each of said shaping rollers at least approximates an arc of a circle having a radius of curvature which is larger than the radius of curvature of said arc of a circle which is at least approximated by the associated peripheral portion of said tube.

3. An apparatus according to claim 1, wherein each shaping roller is mounted to be radially adjustable with respect to said path.

4. An apparatus according to claim 1, wherein each of said shaping rollers is formed in at least one end face with a recess, which is coaxial to the axis of the respective shaping roller and adapted to receive an outer edge portion of an adjacent end face of an adjacent one of said shaping rollers as said two adjacent shaping rollers are moved to approach each other.

5. An apparatus according to claim 1, wherein said pivotal axis associated with each of said shaping rollers is spaced from the center of curvature associated with the respective shaping roller in a direction which is parallel to the axis of the respective shaping roller by a distance which depends on a predetermined angle through which the respective shaping roller is pivotally movable for an adaptation from a first predetermined tube diameter to a second predetermined tube diameter and on the difference between said first and second predetermined tube diameters.

6. An apparatus according to claim 1, wherein a guide is associated with each of said shaping rollers and has a guideway extending along an arc of a circle which is centered on said pivotal axis associated with the respective shaping roller, and each of said shaping rollers is rotatably mounted in a roller-mounting carriage which is movable along said guideway of the associated guide.

7. An apparatus according to claim 6, wherein a plurality of second carriages are provided, which are associated with respective ones of said guides, each of said second carriages is radially movable with respect to said path, and each of said guides is mounted on one of said second carriages.

8. An apparatus according to claim 7, comprising means for adjusting in unison those of said second carriages which are associated with each of said pairs of diametrically opposite shaping rollers.

9. An apparatus according to claim 8 comprising means for adjusting in unison those of said roller-mounting carriages which are associated with each of said pairs of diametrically opposite shaping rollers.

10. An apparatus according to claim 9, wherein said roller-mounting carriages associated with each of said pairs of diametrically opposite shaping rollers are operatively interconnected, said second carriages associated with each of said pairs of diametrically opposite shaping rollers are operatively interconnected, and common drive means are provided for operating those of said roller-mounting carriages and those of said second carriages which are associated with each of said pairs of diametrically opposite shaping rollers.

11. An apparatus according to claim 7, comprising means for adjusting in unison those of said roller-mounting carriages which are associated with each of said pairs of diametrically opposite shaping rollers.

12. An apparatus for continuously shaping a metal tube as it moves along a predetermined path, comprising a plurality of shaping rollers arranged around said path and consisting of pairs of shaping rollers which are diametrically opposite each other with respect to said path, said shaping rollers having axes extending in a common plane perpendicularly to said path, and each of said shaping rollers being mounted to be pivotally movable about an associated pivotal axis which is parallel to said path, each of said shaping rollers having a periphery defining a generatrix, which faces and is concave toward said path and at least approximates an arc of a circle having a predetermined radius of curvature and extending about a center of curvature, the arc defining a portion of a rolling contour according to which said tube is to be shaped, said generatrix of each of said shaping rollers being symmetrical with respect to a diametral center plane of the respective shaping roller, and said pivotal axis associated with each of said shaping rollers extending through the center of curvature of said arc of a circle associated with the respective shaping roller.

13. An apparatus according to claim 12 which is operable to shape a metal tube having peripheral portions each of which has a predetermined shape, which at least approximates an arc of a circle having a radius of curvature, which is smaller than said predetermined radius of curvature of said arc of a circle which is at least approximated by said generatrix of each of said shaping rollers, wherein each of said shaping rollers is adapted to engage an associated one of said peripheral portions of said tube and said generatrix of each of said shaping rollers at least approximates an arc of a circle having a radius of curvature which is larger than the radius of curvature of said arc of a circle which is at least approximated by the associated peripheral portion of said tube.

14. An apparatus according to claim 12, wherein each shaping roller is mounted to be radially adjustable with respect to said path.

15. An apparatus according to claim 12, wherein each of said shaping rollers is formed in at least one end face with a recess, which is coaxial to the axis of the respective shaping roller and adapted to receive an outer edge portion of an adjacent end face of an adjacent one of said shaping rollers as said two adjacent shaping rollers are moved to approach each other.

16. An apparatus according to claim 12, wherein a guide is associated with each of said shaping rollers and has a guideway extending along an arc of a circle which is centered on said pivotal axis respective with the associated shaping roller, and each of said shaping rollers is rotatably mounted in a roller-mounting carriage which is movable along said guideway of the associated guide.

17. An apparatus according to claim 16, wherein a plurality of second carriages are provided, which are associated with respective ones of said guides, each of said second carriages is radially movable with respect to said path, and each of said guides is mounted on one of said second carriages.

18. An apparatus according to claim 17, comprising means for adjusting in unison those of said second carriages which are associated with each of said pairs of diametrically opposite shaping rollers.

19. An apparatus according to claim 18, comprising means for adjusting in unison those of said roller-mounting carriages which are associated with each of said pairs of diametrically opposite shaping rollers.

20. An apparatus according to claim 19, wherein said roller-mounting carriages associated with each of said pairs of diametrically opposite shaping rollers are operatively interconnected, said second carriages associated with each of said pairs of diametrically opposite shaping rollers are operatively interconnected, and common drive means are provided for operating those of said roller-mounting carriages and those of said second carriages which are associated with each of said pairs of diametrically opposite shaping rollers.

21. An apparatus according to claim 17, comprising means for adjusting in unison those of said roller-mounting carriages which are associated with each of said pairs of diametrically opposite shaping rollers.

* * * * *